US006647556B2

(12) United States Patent
Grepper et al.

(10) Patent No.: US 6,647,556 B2
(45) Date of Patent: Nov. 18, 2003

(54) ADJUSTABLE HELMET

(75) Inventors: Theo H. Grepper, Zürich (CH); Martin Knoepfli, Fribourg (CH)

(73) Assignee: Plim Cooperation Ltd., Bern-Liebefeld (CH)

( * ) Notice: Subject to any disclaimer, the term of this patent is extended or adjusted under 35 U.S.C. 154(b) by 53 days.

(21) Appl. No.: 09/842,275

(22) Filed: Apr. 25, 2001

(65) Prior Publication Data

US 2002/0007508 A1 Jan. 24, 2002

(30) Foreign Application Priority Data

Apr. 26, 2000 (DE) ..... 100 20 300

(51) Int. Cl.[7] ..... A63B 71/10
(52) U.S. Cl. ..... 2/425; 2/410; 2/417; 2/418
(58) Field of Search ..... 2/425, 417, 418, 2/419, 420, 410, 411, 414

(56) References Cited

U.S. PATENT DOCUMENTS 3,665,514 A * 5/1972 Durand ..... 2/420
4,404,690 A * 9/1983 Farquharson ..... 2/420
4,477,929 A * 10/1984 Mattsson ..... 2/425
5,012,533 A * 5/1991 Raffler ..... 2/420
5,619,756 A * 4/1997 Garneau ..... 2/425

FOREIGN PATENT DOCUMENTS

WO WO 91/05489 * 5/1991

* cited by examiner

*Primary Examiner*—Rodney M. Lindsey
(74) *Attorney, Agent, or Firm*—Vidas, Arrett & Steinkraus, P.A.

(57) ABSTRACT

An adjustable helmet, particularly a cyclist's helmet having at least one longitudinal spar which is intended to be positioned above the parting, two end pieces one of which is intended to be positioned above the forehead and the other one above the back of the head. Guides between the end pieces and the longitudinal spar which are aligned approximately in parallel with the parting. Two lateral elements which are intended to be positioned above the temples, guides between the end pieces and the lateral elements which are aligned obliquely to the parting, and an adjusting and/or locating device for the relative position of the longitudinal spar, end pieces, and lateral elements.

23 Claims, 7 Drawing Sheets

ADJUSTABLE HELMET

CROSS-REFERENCE TO RELATED APPLICATIONS

Not Applicable

STATEMENT REGARDING FEDERALLY SPONSORED RESEARCH

Not Applicable

BACKGROUND OF THE INVENTION

The invention relates to an adjustable helmet, particularly a cyclist's helmet.

Helmets are headpieces made of plastic or metal which are intended to protect the user from detrimental or injury-causing influences. Thus, driver's helmets serve for shock absorption during a fall, worker's helmets protect from objects that fall down, and fireman's helmets which additionally have a vapour-deposited outer surface protect from the effects of heat. Helmets are also used in various sports as a protection against falls, sports equipment or objects that fall down, particularly in cycling, inline skating, riding, ice hockey or mountain climbing.

In many cases, helmets consist of a resistive outer shell which, for being worn, may be fixed at some points to an insert which is adjustable or, in part, is even removable and has a crossed rib. Many helmets have an outer shell with a cushioning lining in moulded plastic foam, particularly as a protection from shocks. Such helmets are used in cycling, in particular. However, there are also helmets which are integrally pressed from solid plastic foam and are worn with no specific inserts and with or without a padding. An adjustable chin strap allows them to be safely worn in most designs.

The known helmets which are lined with plastic foam or are integrally pressed from solid plastic foam generally are accommodated to a certain head size. However, such helmets also exist with an inner ring or a retaining plate which allow them to be adjustably supported on the circumference of the head to allow accommodation to different head sizes. Such systems may be adjustable, in particular, via Velcro closures or adjusting rings. These possible adjustments, however, involve losses to safety because the head is not directly supported via cushioning members in the shell, at least in some areas.

In addition, helmets are known already with exchangeable plastic foam paddings which allow them to be accommodated to various head shapes. However, such systems cause great expenditure and are restricted in variability.

Therefore, it is the object of the invention to provide a helmet of an improved adjustability with no loss to safety and with no need to exchange accommodating elements.

BRIEF SUMMARY OF THE INVENTION

An adjustable helmet, particularly a cyclist's helmet, according to the invention has

- at least one longitudinal spar which is intended to be positioned above the parting,
- two end pieces one of which is intended to be positioned above the forehead and the other one above the back of the head,
- guides between the end pieces and the longitudinal spar which are aligned approximately in parallel with the parting,

- two lateral elements which are intended to be positioned above the temples,
- guides between the end pieces and the lateral elements which are aligned obliquely to the parting, and
- an adjusting and/or locating device for the relative position of the longitudinal spar, end pieces, and lateral elements.

This helmet provides adjustability in the longitudinal direction and cross direction by the fact that the longitudinal spar and the end pieces are adapted to be displaced with respect to each other along the guide aligned approximately in parallel with the parting, and that end pieces and lateral elements are adapted to be displaced relative to each other along the guides directed obliquely to the parting. Since the displacement of the end pieces also implies the one of the lateral elements the adjustment of the length and width of the helmet is simultaneous. The adjusting and/or locating devices, in particular, may be such as locate the longitudinal spar, end pieces, and lateral elements in a relative position which is achieved by manually acting on those elements. Thus, the devices may specifically be clamping devices which locate the end pieces on at least one of the guides. However, the devices may also be devices which when actuated cause a change to the relative position of the aforementioned elements to each other. Those can be designed so as to be capable, in addition, of maintaining the elements in an adjusted position.

Thus, the inventive helmet allows to make changes to both the longitudinal and transverse dimensions of a helmet in an extremely simple manner. The components the relative position of which is changed here may be cushioning elements which are made from a plastic foam, for example, so that no losses to safety will occur. Moreover, it is unnecessary to exchange components for an adjustment to different head sizes.

According to an advantageous aspect, the helmet may have two longitudinal spars which are approximately parallel. Each of these parallel longitudinal spars may be guided with respect to the end pieces by means of guides aligned approximately in parallel with the parting. Preferably, the parallel longitudinal spars may be connected to each other by cross webs in order to form a particularly stable helmet component which can be arranged above the parting.

The end pieces may have longitudinal-spar end portions which are flush with the at least one longitudinal spar and which are engaged by the guides aligned approximately in parallel with the parting. This helps achieve a continuation of the stabilizing, weight-saving, and air permeable spar structure up to the inside of the end portions.

According to another aspect, the lateral elements also are designed as curved spars. The end pieces further may be designed with legs aligned in a U shape and/or V shape which are engaged by the guides aligned obliquely to the parting.

If the aforementioned aspects are combined with each other the helmet will be of a structure comprising longitudinal spars overlapping the partings and lateral spars overlapping the temples with all of the spars being converged at the ends above the back of the head and the forehead in end piece material accumulations which provide a particularly good protection.

According to another aspect, guides directed transversely to the parting are arranged between the at least one longitudinal spar and the lateral elements, which stabilize the helmet in a cross direction and prevent a relative displacement of the longitudinal spar and the lateral elements in a longitudinal direction.

The guides directed in parallel with and/or obliquely to and/or transversely to the parting may have straight-lined guide bodies which engage complementary pockets of the longitudinal spar and/or the end pieces and/or the lateral elements. Then, the guides may be completely integrated in the cross-sections of the various components so as not to form interfering components or components that are even apt to cause injuries.

If was mentioned already the adjusting and/or locating device may solely serve for fixing the elements in their manually adjusted relative position. Instead, however, it may be a device which allows to adjust the relative position. In addition, the setting device may have self-locking properties such that it also is a device for locating the elements in the relative position chosen.

The adjusting and/or locating device may be designed in different ways. In a particularly advantageous aspect, this device has at least one setting screw which engages at least two of the elements adapted to be displaced relative to each other in order to change their relative position by rotating the setting screw by means of an actuating member which is connected thereto. The guides between the displaceable elements ensure that the elements which are not engaged by the setting screw are appropriately displaced. Moreover, the setting screw may fix the elements in the relative position adjusted by means of a threadable, self-locking engagement with these.

It is particularly advantageous if the setting screw extends across three adjacent elements the relative position of which needs a displacement, and engages at least the two outer ones of these elements because a uniform displacement of all elements and a particularly firm coherence thereof may then be realized in their adjusted position. To this end, the setting screw particularly may extend through the longitudinal spar and into the two end pieces so as to cause their displacement directly and the displacement of the lateral elements indirectly via guides.

Generally, however, it is also possible for the setting screw to extend through the longitudinal spar and into the two end pieces in a cross direction in order to displace the lateral elements directly and the end pieces indirectly via guides. Further, the setting screw may also extend into two end pieces through a lateral element or into two lateral elements through one end piece.

According to an advantageous aspect, the setting screw is designed to be flexible so that it may follow a bulging of the elements being adjusted that these have for an adaptation to the general shape of a human's head. This also helps achieve that the screw is surrounded by cushioning material at any point, which farther improves safety. On the other hand, this favours an accommodation of the elements being adjusted to the shape of the head and their thin-walled design. It is preferred that the setting screw be designed flexible if it extends across elements that need an adjustment.

The setting screw engages at least one of the elements to be adjusted by being in a threadable engagement with those. Basically, it may be in a threadable engagement with all elements through which or into which it extends. Oppositely directed threads or threads having different pitches can ensure that the elements are displaceable towards each other or away from each other by rotating the setting screw. It is not definitely necessary for the screw to engage the longitudinal spar. Rather, its position may be clearly defined by guides which are parallel or directed transversely to the parting.

According to an advantageous aspect, the setting screw has an axial support on one of the elements so that when actuated it will not be displaced with respect to this element. This favours a stationary mounting of an actuating member.

According to a further aspect, there are two setting screws which are symmetrically arranged. This promotes an axial alignment, a setting, and a safe location of the elements. For example, the setting screws may be guided into the two end pieces through longitudinal spars which are substantially parallel. However, they also may extend into the two end pieces through the two lateral elements. In addition, it naturally is also possible for the two setting screws to extend into the lateral elements through the two end pieces.

Two setting screws may be adjustable by means of a separate or common actuating member which acts on the two setting screws via a gear set. The gear set may specifically be a wheel gear set. In particular, it may be a spur gear set, a bevel gear set or a worm gear set, depending on how the setting screws and the actuating member are aligned towards each other.

On a principle, however, the adjusting and/or locating device can be designed in another way. For example, it may have two toothed racks the ends facing away from each other are connected to various elements that need an adjustment (e.g. the end pieces) and, in an overlapping area, mesh with a gear which is supported on a further element (e.g. the longitudinal spar) and can be adjusted by means of an actuating member. The actuating member may be arranged on the same element as is the gear, or on another, in which case it is connected to the gear via a shaft. The toothed racks and, if necessary, the shaft may be designed to be flexible.

Preferably, the actuating member is designed as an adjusting gear.

The elements being adjusted which are intended to be positioned on the head of the wearer directly or via a padding on the inside may be made, completely or in part, of a cushioning material. Specifically, they may be made of a plastic foam.

The adjusting and/or locating devices may be made, completely or in part, of a plastic material.

The material which also is particularly suited for use in guide bodies of the guides is plastic or metal.

Generally, it is possible for the elements being adjusted to define the outer surface of the helmet. Furthermore, the helmet may have a shell at its outside. This can be fixed, in particular, only to one of the elements that need an adjustment. However, the shell can also be defined by portions that imbricatedly overlap each other and are fixed only to one of the elements each.

BRIEF DESCRIPTION OF THE SEVERAL VIEWS OF THE DRAWINGS

The invention will now be explained in more detail with reference to the accompanying drawings of an embodiment. In the drawings.

DETAILED DESCRIPTION OF THE INVENTION

Figure 1:
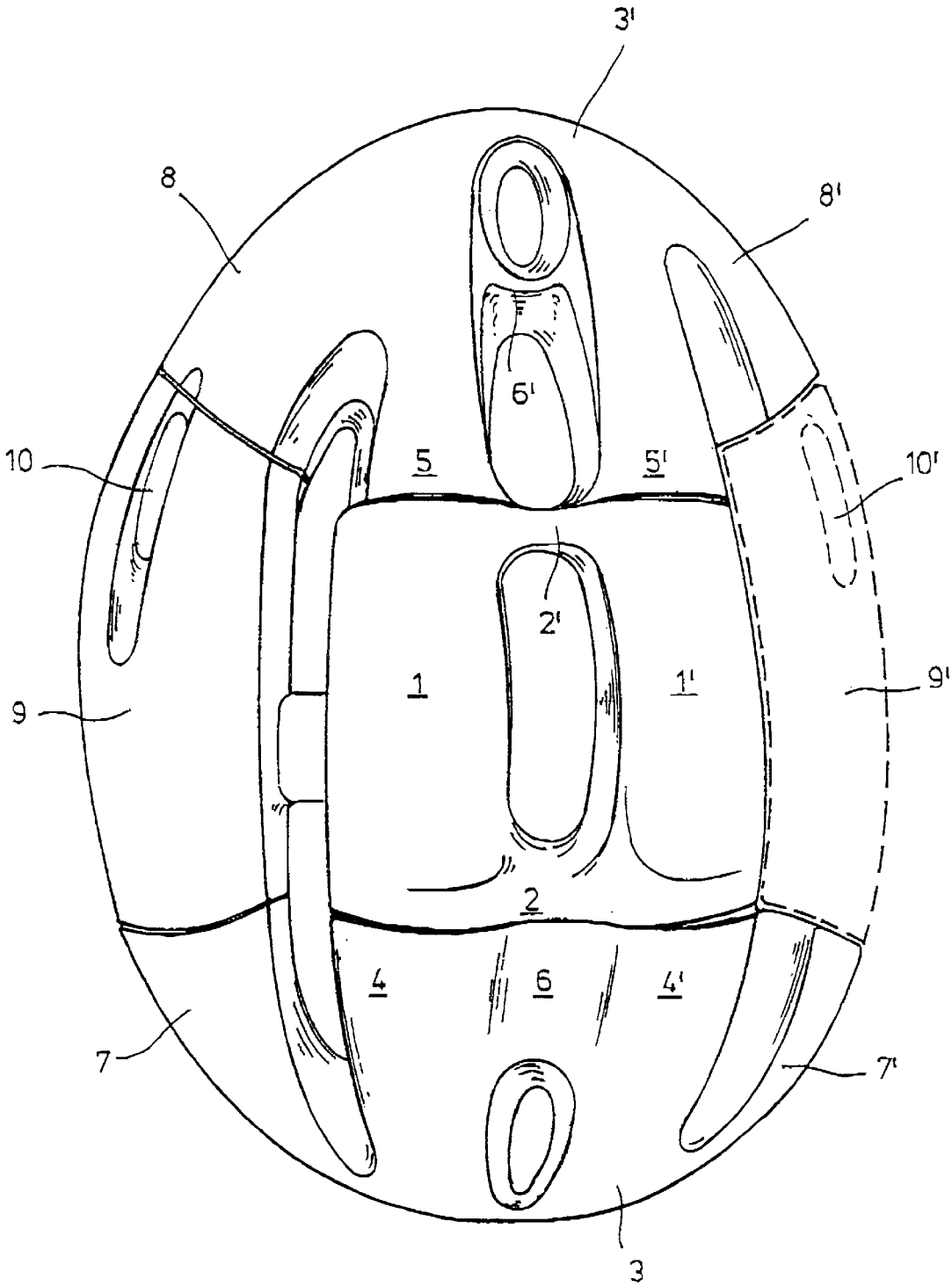
FIG. 1 shows a plan view of a helmet skeleton with the adjustable components in their smallest settings.

While this invention may be embodied in many different forms, there are described in detail herein a specific preferred embodiment of the invention. This description is an exemplification of the principles of the invention and is not intended to limit the invention to the particular embodiment illustrated.

The helmet has two longitudinal spars 1, 1' which are integrally connected to each other by cross webs 2, 2'. This component is intended to be worn approximately above the parting.

It further has two end pieces 3, 3' of which one 3 is intended to be worn above the forehead and the other one 3' is intended to be worn above the back of the head. The end pieces 3, 3' each are integrally connected to longitudinal-spar end portions 4, 4', 5, 5' of which the ones 4, 5 are flush with the longitudinal spar 1 and the other ones 4', 5' are flush with the longitudinal spar 1'. The longitudinal-spar end portions 4, 4' of the end pieces 3, 3' also are connected to each other by cross webs 6, 6' here, which stabilizes them.

Moreover, the end pieces 3, 3' have integral legs 7, 7' and 8, 8' which extend towards the temples along the sides of the forehead and the back of the head. Legs 7, 7' are arranged approximately in a U shape and legs 8, 8' are arranged approximately in a V shape.

Legs 7, 8 and legs 7', 8' each have arranged a lateral component 9, 9' therebetween, the latter of which is drawn in broken lines. The lateral elements 9, 9' are realized as a spar which is curved at least at its outside. They are provided with lateral through openings 10, 10'.

Each of the aforementioned components is made of a cushioning plastic foam.

Between the longitudinal spar 1 and the longitudinal-spar end portions 4, 5 and between the longitudinal spar 1' and the longitudinal-spar end portions 4', 5', there are guide bodies 11, 12 and 11', 12' which are designed as plastic sleeves. At their one ends, these have a projecting border 13, 14 at which they are anchored each on a longitudinal spar 1. At their other end, they are guided in pockets 15, 16 of the adjacent end pieces 3, 3'. The guides thus formed are aligned approximately in parallel with the parting of a wearer and are slightly curved in conformity with the bulging of the components 1, 1', 3, 3'.

In addition, the lateral elements 9 and the legs 7, 8 as well as the lateral component 9' and the legs 7', 8' have disposed therebetween guides with guide bodies 17,18 and 17', 18' which are aligned obliquely to the parting of swearer in conformity with the legs. At this point, the guide bodies 17, 18 which can be plate-shaped plastic elements can be anchored in the lateral elements 9, 9' and can be inserted in pockets of the legs 7, 8 and 7', 8'.

Finally, the longitudinal spar 1 and the lateral component 9 as well as the longitudinal spar 1' and the lateral component 9' have disposed therebetween guides directed transversely to the parting which also have guide bodies 19, 19'. Again, those can be plate-shaped plastic bodies. Those guide bodies 19, 19' can also be anchored in a lateral component 9, 9' each, on one side, and can be guided in pockets of the longitudinal spars 1, 1', on the other.

The helmet skeleton thus formed can be easily slid together by inserting the lateral elements 9, 9' with the guide bodies 19, 19' into the longitudinal spars 1, 1' and, subsequently, sliding the end pieces 3 and 3' onto the guide bodies 11, 11'; 17, 17', and 12, 12', 18, 18'.

Figure 2:
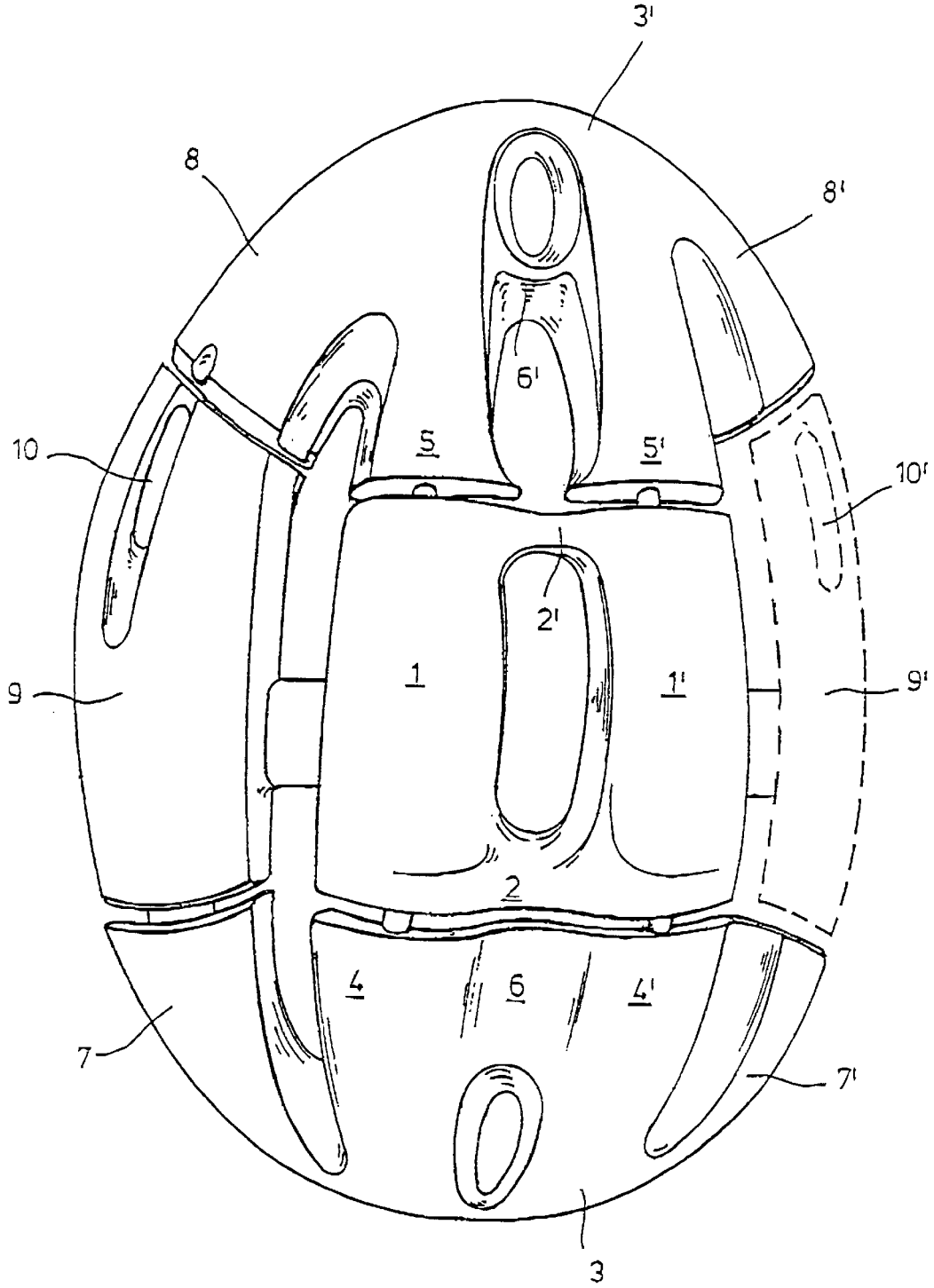
FIG. 2 shows a plan view of the same helmet skeleton in its intermediate setting.
Figure 3:
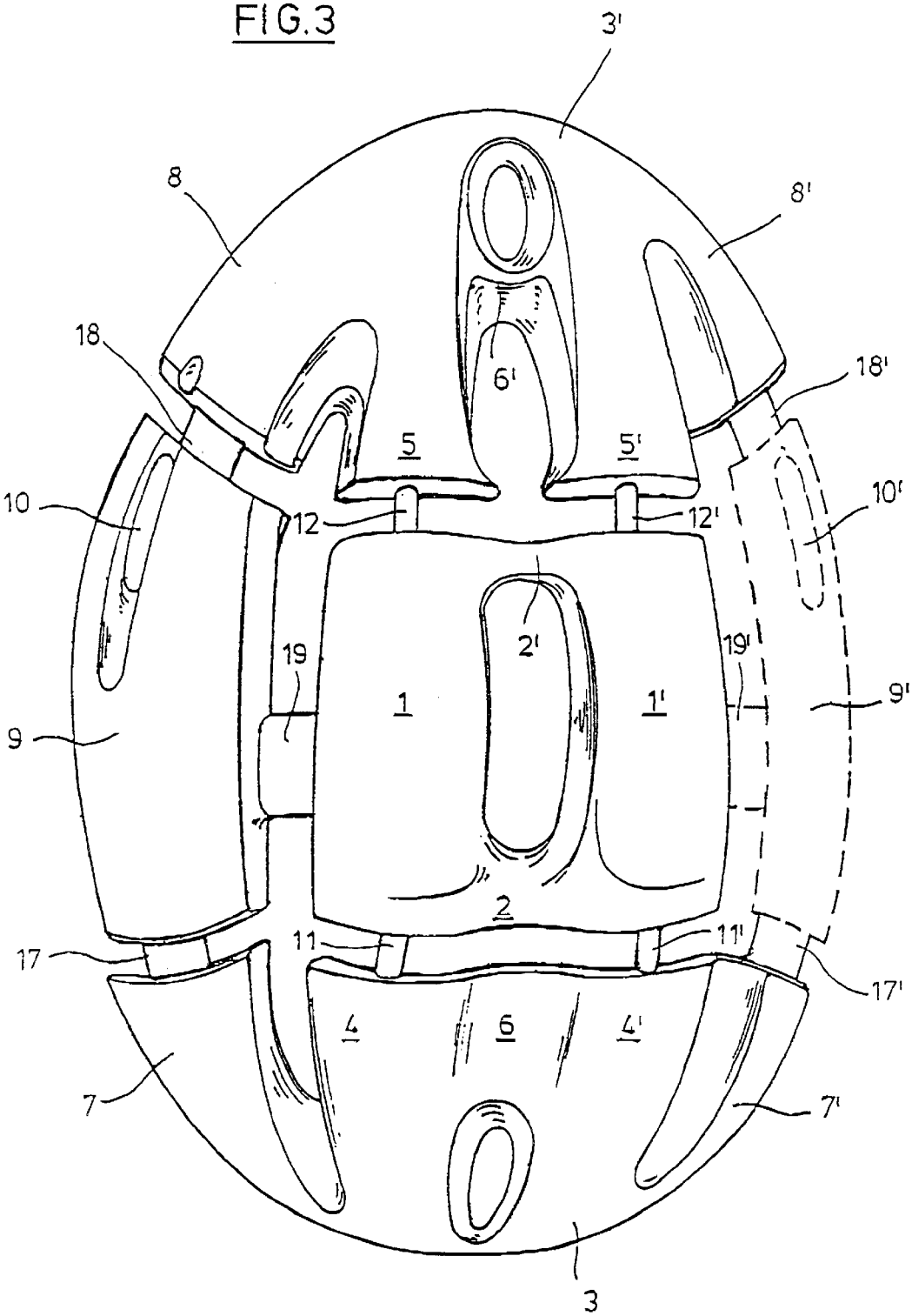
FIG. 3 shows a plan view of the same helmet skeleton in their largest setting.

This makes it possible afterwards to shift the relative position of the aforementioned components with respect to each other by displacing only two of these components with respect to each other. Preferably, it is the end pieces 3, 3' which are displaced relative to each other, the effect being that the lateral elements 9, 9' and the longitudinal spars 1, 1' will then be forcibly displaced via the aforementioned guides. This causes a simultaneous change to both the longitudinal dimensions and transverse dimensions of the helmet. This is shown as a sequence in FIGS. 1 through 3.

Figure 4:
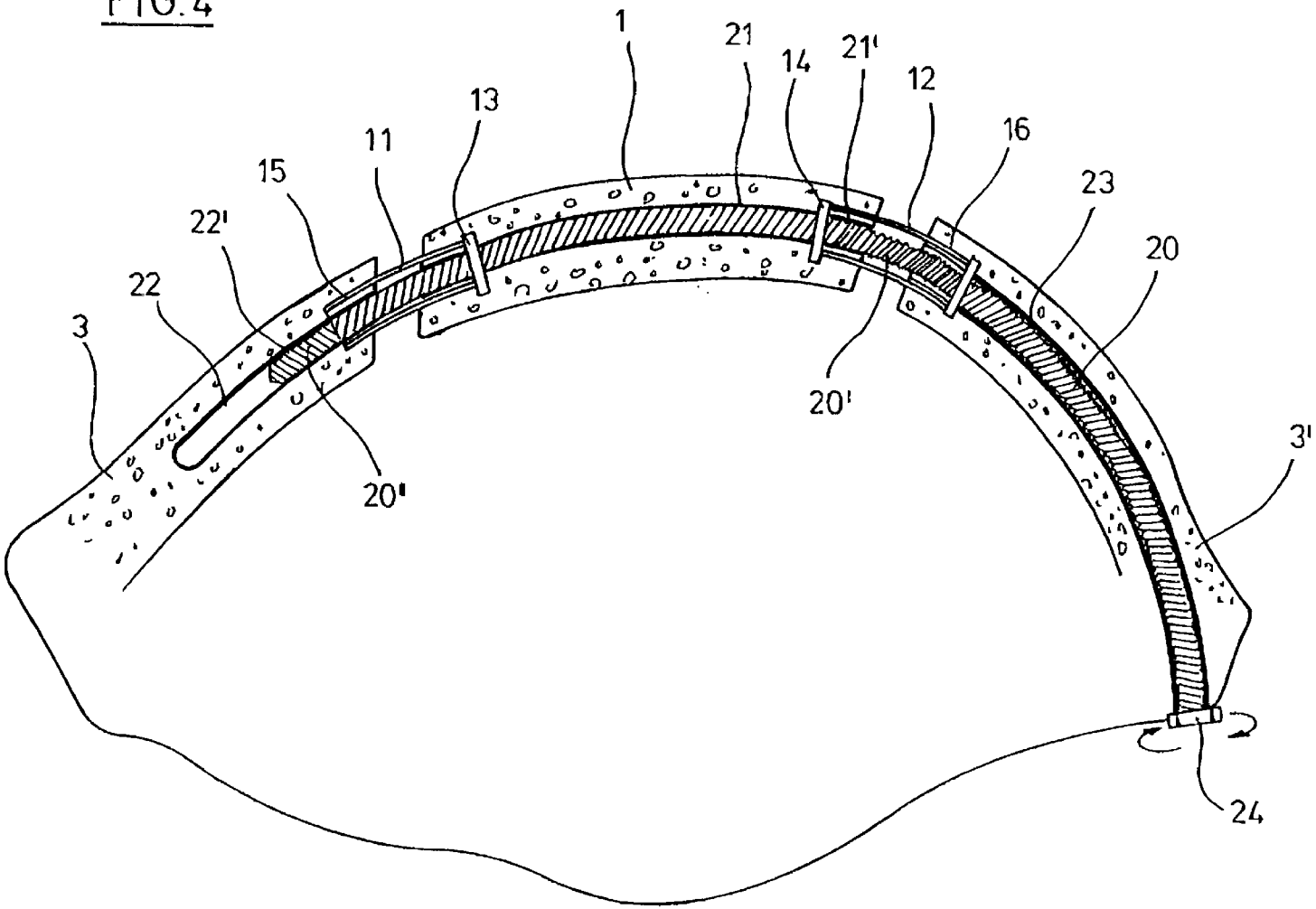
FIG. 4 shows a longitudinal section through a longitudinal spar of the same helmet skeleton.

For an adjustment and location of the relative position of the elements, there are setting screws of which only one 20 is shown in FIG. 4. It extends through a through bore 21 of the longitudinal spar 1 and also is passed through the guide bodies 11, 12. The screw 20 has a threaded portion 20' which is in engagement with a respective thread 21 ' of the through bore 21.

Furthermore, the flexible screw 20 is introduced, at one end, into a blind bore 22 as a continuation of the pocket 15 of the end piece 3. An end-sided threaded portion 20" of the screw 20 is in engagement with a respective thread 22' of the blind bore 22.

Moreover, the screw 20 is introduced through the guide body 12 and into a through bore 23 as a continuation of the pocket 16 of the end piece 3'. The screw 20 is axially supported in the through bore 23 with the supports not being shown.

A setting screw 20' which is not shown is introduced through the longitudinal spar 1' and into the end pieces 3, 3' in an appropriate relationship.

The two setting screws 20 can be actuated via an adjusting gear 24 which acts on respective spur gears of the setting screws via a spur gear which is not shown. The adjusting gear is mounted on the underside of the end piece 3' at a location accessible from outside on the back of the head.

Actuating the adjusting gear 24 now makes it possible to displace the end pieces 3, 3' towards and away from the interposed longitudinal spars 1, 1'. This is caused by the axial support of the setting screws 20 in the end piece 3' and the threads engaging the longitudinal spars 1, 1' and the end piece 3. It should be taken into account here that the threads 20, 20' are oppositely directed and have different pitches so that rotating the setting screws 20 will cause the end pieces 3, 3' to uniformly approach and move away from the longitudinal spars 1, 1'.

Figure 5:
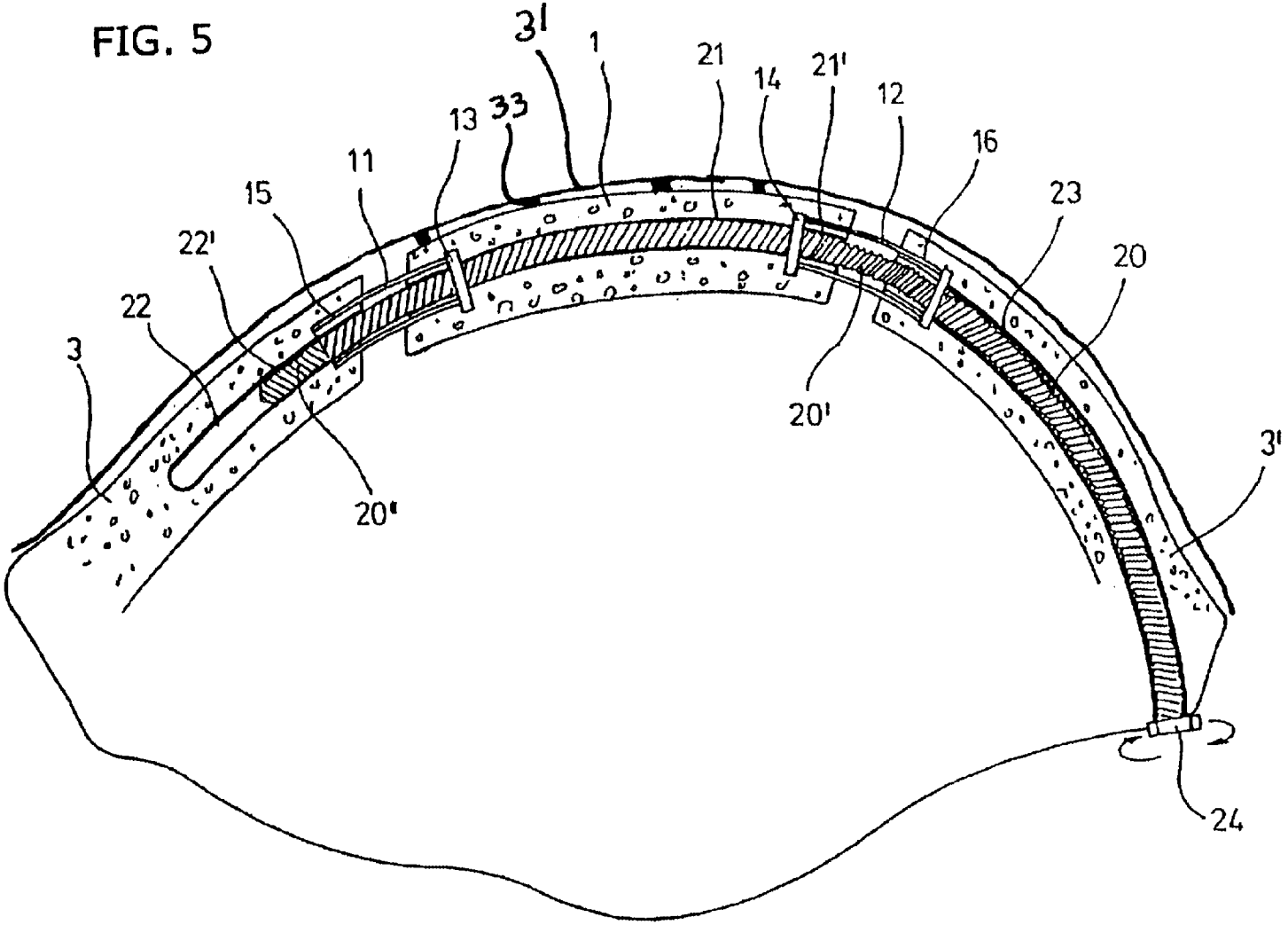
FIG. 5 shows the same helmet skeleton with an outer shell affixed.
Figure 6:
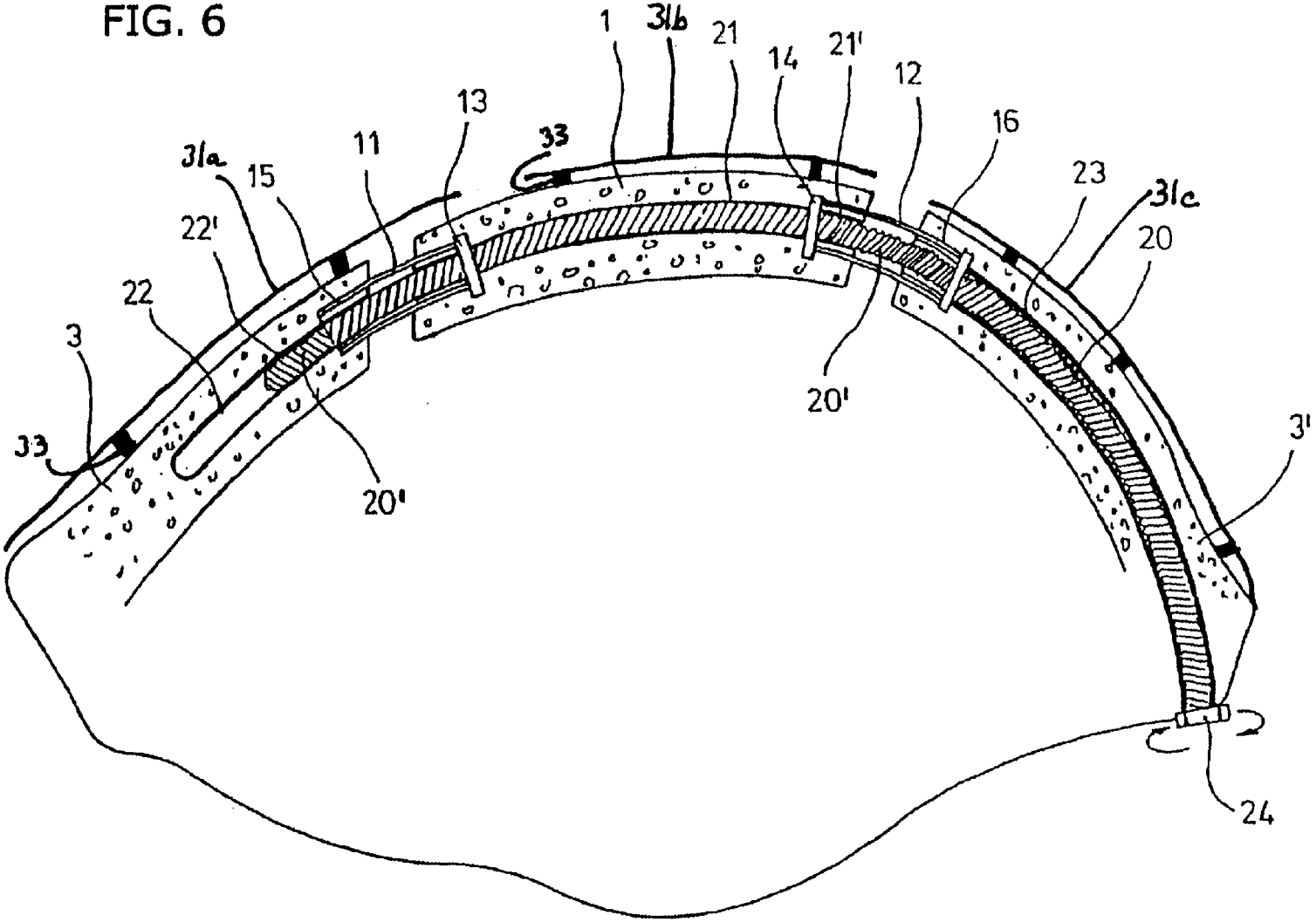
FIG. 6 shows the same helmet skeleton with an affixed outer shell comprising a plurality of portions.
Figure 7:
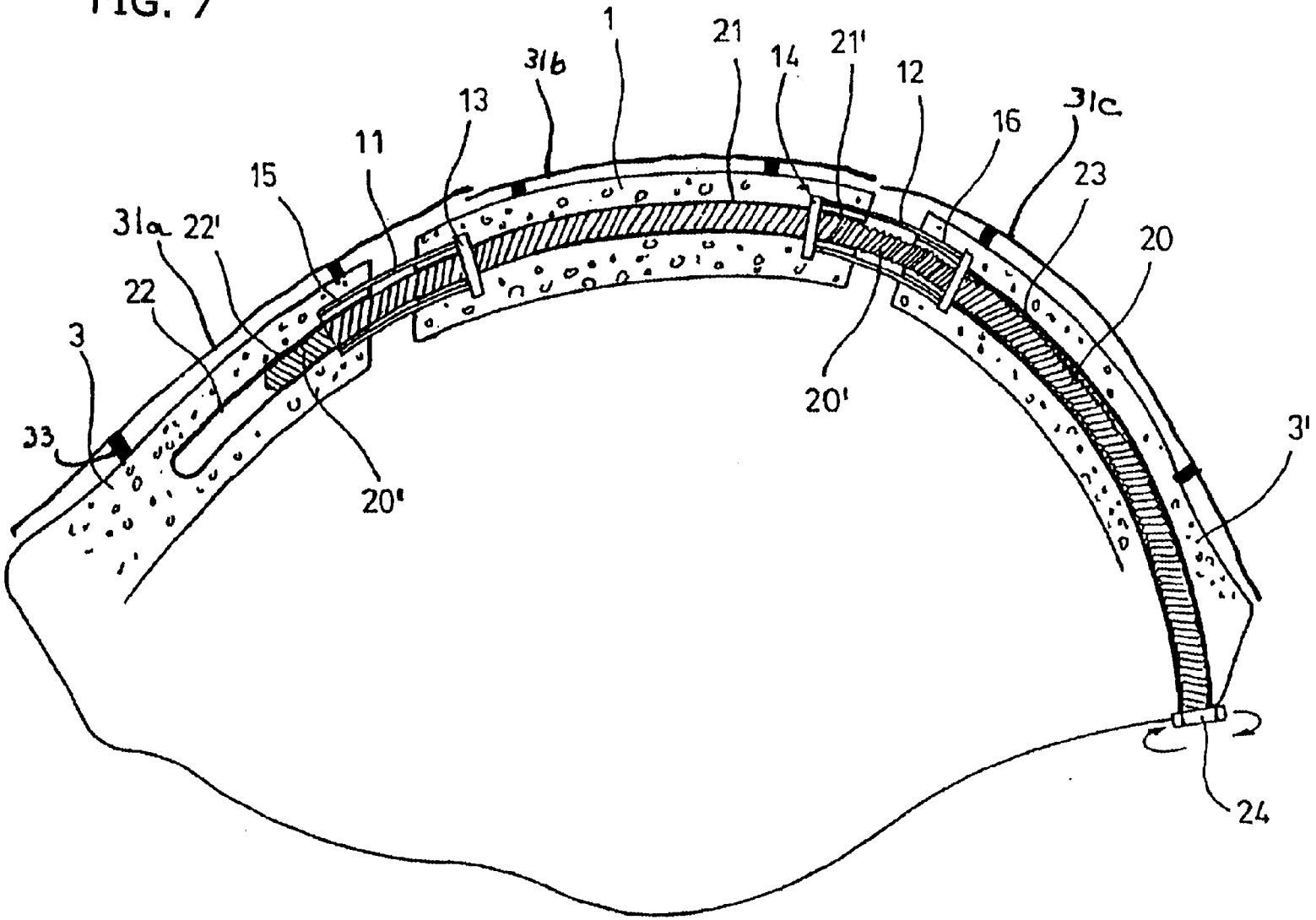
FIG. 7 shows the same helmet skeleton with an affixed outer shell comprising a plurality of portions which overlap each other.

In FIG. 5 a shell 31 is affixed to the outside of the helmet by at least one affixer 33. In this figure the shell is affixed to only one of the elements that need an adjustment. In this embodiment it is affixed to a longitudinal spar 1. However, the shell can also be defined by shell portions 31*a*, 31*b*, 31*c* as shown in FIG. 6. As shown in FIG. 7 the shell portions 31*a*, 31*b*, 31*c* may also overlap each other. In at least one embodiment each shell portion is affixed individually to each one of the at least one longitudinal spar (1,1'), the at least one end pieces (3,3'), and the at least one lateral elements (9,9').

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. An adjustable helmet with a parting, particularly a cyclist's helmet, comprising;

at least two longitudinal spars (1, 1') which are intended to be positioned above the parting, the longitudinal spars being approximately parallel, two end pieces (3, 3') one of which is intended to be positioned above the forehead and the other one above the back of the head, guides (11, 11', 12, 12') between the end pieces (3, 3') and the longitudinal spars (1, 1') which are aligned approxmiately in parallel with the parting, two lateral elements (9, 9') which are intended to be positioned above the temples, guides (17, 18, 17', 18') between the end pieces (3, 3') and the lateral elements (9, 9') which are aligned obliquely to the parting, and an adjusting and/or locating device (20, 24) for the relative position of the longitudinal spars (1, 1'), end pieces (3, 3'), and lateral elements (9, 9').

2. The helmet according to claim 1 having an adjusting gear (24).

3. The helmet according to claim 1 wherein the parallel longitudinal spars (1, 1') are connected to each other by cross webs (2, 2').

4. The helmet according to claim 1 wherein the end pieces (3, 3') have longitudinal-spar end portions (4, 4', 5, 5') which are flush with the at least one longitudinal spar(1, 1') and which are engaged by the guides (11, 11', 12, 12') aligned in parallel with the parting.

5. The helmet according to claim 1 wherein the lateral elements (9, 9') are curved spars.

6. The helmet according to claim 1 wherein at least one setting screw (20) and/or an actuating member (24) and/or an actuating gear set are made of a plastic material.

7. The helmet according to claim 1 wherein guides (19, 19') directed transversely to the parting are arranged between the at least one longitudinal spar (1, 1') and the lateral elements (9, 9').

8. The helmet according to claim 1 wherein the guides directed in parallel with and/or obliquely to and/or transversely to the parting have straight-lined or slightly curved guide bodies (11 to 12'; 17 to 19') which engage complementary pockets (15, 16) of the longitudinal spar (1, 1') and/or the end pieces (3, 3') and/or the lateral elements (9, 9').

9. The helmet according to claim 1 wherein the at least one longitudinal spar (1, 1') and/or the end pieces (3, 3') and/or the lateral elements (9, 9') is/are made of a cushioning material, at least in part.

10. The helmet according to claim 1 wherein the at least one longitudinal spar (1, 1') and/or the end pieces (3, 3') and/or the lateral elements (9, 9') is/are made of a plastic foam.

11. The helmet according to claim 1 wherein the at least one longitudinal spar (1, 1') and/or the end pieces (3, 3') and/or the lateral elements (9, 9') have a padding at their insides.

12. An adjustable helmet with a parting, particularly a cyclist's helmet, comprising:

at least one longitudinal spar (1, 1') which is intended to be positioned above the parting, two end pieces (3, 3') one of which is intended to be positioned above the forehead and the other one above the back of the head, the end pieces (3, 3') having legs (7, 7', 8, 8') aligned in a U shape or V shape which are engaged by the guides (17, 17', 18, 18') aligned obliquely to the parting, guides (11, 11', 12, 12') between the end pieces (3, 3') and the longitudinal spar (1, 1') which are aligned approximately in parallel with the parting, two lateral elements (9, 9') which are intended to be positioned above the temples, guides (17, 18, 17', 18') between the end pieces (3, 3') and the lateral elements (9, 9') which are aligned obliquely to the parting, and an adjusting and/or locating device (20, 24) for the relative position of the longitudinal spar (1, 1'), end pieces (3, 3'), and lateral elements (9, 9').

13. An adjustable helmet with a parting, particularly a cyclist's helmet, comprising:

at least one longitudinal spar (1, 1') which are intended to be positioned above the parting, two end pieces (3, 3') one of which is intended to be positioned above the forehead and the other one above the back of the head, guides (11, 11', 12, 12') between the end pieces (3, 3') and the longitudinal spar (1, 1') which are aligned approximately in parallel with the parting, two lateral elements (9, 9') which are intended to be positioned above the temples, guides (17, 18, 17', 18') between the end pieces (3, 3') and the lateral elements (9, 9') which are aligned obliquely to the parting, and an adjusting and/or locating device (20, 24) for the relative position of the longitudinal spar (1, 1'), end pieces (3, 3'), and lateral elements (9, 9'), the adjusting and/or locating device having a setting screw (20) and an actuating member (24) coupled thereto, the setting screw (20) rotatable by means of the actuating member (24) to change the relative position of the longitudinal spar (1, 1'), the end pieces (3, 3'), and the lateral elements (9, 9'), the setting screw (20) engages at least two members of the group consisting of the longitudinal spar (1, 1'), the end pieces (3, 3'), and the lateral elements (9, 9').

14. The helmet according to claim 13 wherein the setting screw (20) extends across three adjacent components the relative position of which needs an adjustment, the three adjacent components including two outer components, the setting screw engages a least the two outer components.

15. The helmet according to claim 14 wherein the setting screw (20) extends through the longitudinal spar (1, 1') and into the two end pieces (3, 3').

16. The helmet according to claim 13 wherein the setting screw (20) threadably engages at least one of the members of the group consisting of the longitudinal spar (1, 1'), the end pieces (3, 3'), and the lateral elements (9, 9') the relative position of which needs an adjustment.

17. The helmet according to claim 13 wherein the setting screw has an axial support on a component having a relative position which needs an adjustment.

18. The helmet according to claim 17 wherein the setting screw (20) has the axial support in an end piece (3'), on which end piece the actuating member (24) is arranged.

19. The helmet according to claim 13 which has at least one setting screw (20) which extends through different longitudinal spars (1, 1').

20. An adjustable helmet with a parting, particularly a cyclist's helmet, comprising:

at least one longitudinal spar (1, 1') which is intended to be positioned above the parting, two end pieces (3, 3') one of which is intended to be positioned above the forehead and the other one above the back of the head, guides (11, 11', 12, 12') between the end pieces (3, 3') and the longitudinal spar (1, 1') which are aligned approximately in parallel with the parting, the guides (11 to 12') in parallel with the parting and/or the obliquely directed guides (17 to 18') having straight-lined and/or slightly curved guide bodies in plastic, two lateral elements (9, 9') which are intended to be positioned above the temples, guides (17, 18, 17', 18') between the end pieces (3, 3') and the lateral elements (9, 9') which are aligned obliquely to the parting, and an adjusting and/or locating device (20, 24) for the relative position of the longitudinal spar (1, 1'), end pieces (3, 3'), and lateral elements (9, 9').

21. An adjustable helmet with a parting, particularly a cyclist's helmet, comprising:

at least one longitudinal spar (1, 1') which is intended to be positioned above the parting, two end pieces (3, 3') one of which is intended to be positioned above the forehead and the other one above the back of the head, guides (11, 11', 12, 12') between the end pieces (3, 3') and the longitudinal spar (1, 1') which are aligned approximately in parallel with the parting, two lateral elements (9, 9') which are intended to be positioned above the temples, guides (17, 18, 17', 18') between the end pieces (3, 3') and to lateral elements (9, 9') which are aligned obliquely to the parting, and an adjusting and/or locating device (20, 24) for the relative position of the longitudinal spar (1, 1'), end pieces (3, 3'), and lateral elements (9, 9'), the helmet having a shell at its outside.

22. The helmet according to claim 21 wherein the shell is fixed to the at least one longitudinal spar (1, 1').

23. The helmet according to claim 21 wherein the shell has portions that imbricatedly overlap each other and are fixed only to each one of the elements longitudinal spar (1, 1'), end pieces (3, 3'), and lateral elements (9, 9').

* * * * *